United States Patent [19]

Vanni et al.

[11] Patent Number: 4,560,384

[45] Date of Patent: Dec. 24, 1985

[54] PROCESS FOR TANNING HIDES

[75] Inventors: Sergio Vanni, S.Croce Sull'Arno, Italy; Loris Guidi, 55, Via di Poggio Adorno, S.Croce Sull'Arno, Pisa, Italy; Paolo Vallini, San Miniato, Italy; Renato C. Pace, Alessandria, Italy; Carlo Scotti, Voghera, Italy

[73] Assignees: Loris Guidi, Pisa; Sibit S.p.A., Milan, both of Italy

[21] Appl. No.: 618,220

[22] Filed: Jun. 7, 1984

[30] Foreign Application Priority Data

Jun. 10, 1983 [IT] Italy ..... 21550 A/83

[51] Int. Cl.[4] ..... C14C 5/00

[52] U.S. Cl. ..... 8/94.21; 8/94.24; 8/94.25

[58] Field of Search ..... 8/94.21, 94.24, 94.25

[56] References Cited

U.S. PATENT DOCUMENTS

| | | | |
|---|---|---|---|
| 3,852,431 | 12/1974 | Motov | 423/549 |
| 3,938,951 | 2/1976 | Motov et al. | 8/94.25 |
| 4,260,686 | 4/1981 | Asbeck et al. | 8/94.14 |
| 4,396,387 | 8/1983 | Motov et al. | 8/94.21 |
| 4,398,911 | 8/1983 | May et al. | 8/94.21 |
| 4,443,221 | 4/1984 | May et al. | 8/94.21 |

OTHER PUBLICATIONS

Roman, A. S. et al. "Stabilization of Solutions of a Titanium Tanning Agent with Organic Acids", Izv. Vyssh. Uchebn. Zaved., Tekhnol. Leck. Prum-Sti, 1974 (5), 31-35.

Derwent Abstract, 27091S-DE., French Patent (2042206-Q), Mar. 26, 1970.

*Primary Examiner*—Prince E. Willis

*Assistant Examiner*—Willie J. Thompson

*Attorney, Agent, or Firm*—Stevens, Davis, Miller & Mosher

[57] ABSTRACT

A process for tanning hides for soles or insoles with ammonium titanyl sulphate. The hides, subjected to soaking, liming, fleshing, and deliming, are first treated with ammonium sulphate. Successively, ammonium titanyl sulphate as well as citric acid or an alkali metal citrate are gradually added to the bath, while maintaining the temperature of the bath at a value not exceeding 37° C. and a pH at values ranging from 1.7 to 2.5. After each addition, the hides are treated until they have absorbed at least 90% of the soluble Ti (IV). Sodium sulphite and hexamethylenetetramine are then gradually added: this addition is such as to bring the final pH of the bath to 3.8-4.5 and to exhaust the bath in soluble Ti (IV). $NaHCO_3$ is successively added until a pH value of the bath ranging from 4.0 to 5.0 is reached, such pH being maintained for at least 2 hours. At least one tanning treatment with a tannin, either prior to the treatment with ammonium titanyl sulphate (pretanning), or after the treatment with $NaHCO_3$ (additional tanning), is carried out, said tanning being accomplished with a synthetic or vegetable tannin in the former case, and with a synthetic tannin in the latter case.

10 Claims, No Drawings

PROCESS FOR TANNING HIDES

This invention relates to a process for tanning hides. More particularly, it relates to a process for tanning hides for soles and insoles.

It is known that ammonium titanyl sulphate can be utilized as a tanning agent for hides. To this purpose, delimed hides are subjected to a pretreatment with an activating substance, for example, phthalic anhydride. Then follows the tanning with ammonium titanyl sulphate. Tanning can then be carried on with tannins. This method gives rise to several drawbacks: first of all, due to the instability of the solution of ammonium titanyl sulphate, titanium hydroxide can precipitate, which adversely affects the qualitative constancy or uniformity of the tanned article. Furthermore, the permeability to water of the treated hide is too high. Lastly, the process exhibits limitations in the use of additional tanning agents; in fact, it has been ascertained that natural tannins and many synthetic tannins impart an intense coloration to the article, limiting the possibilities of use thereof.

Thus, it is an object of the present invention to provide a process for tanning hides for soles and insoles with ammonium titanyl sulphate, which fully prevents the precipitation of titanium hydroxide during tanning.

Another object is that of providing a process by means of which it is possible to obtain the complete fixation of Ti (IV) on the hide, while completely exhausting the tanning bath in Ti (IV).

A further object is that of obtaining a good impermeability to water, when the use for which the hide is intended so requires.

Still another object is that of enabling one, if necessary or desired, to carry out a complementary tanning with synthetic tannins which does not bring about undesired colorations of the leather.

Another object is that of providing a process by means of which it is possible to obtain leather endowed with high softness and high flexibility.

These and still other objects of the present invention are achieved by the instant process for tanning hides for soles and insoles, according to which the hides, after having been subjected to soaking, liming, fleshing, and deliming, are tanned with ammonium titanyl sulphate. The process is characterized in that the hides are first treated with ammonium sulphate. Successively, titanyl ammonium sulphate and citric acid or an alkali metal citrate are gradually added to the bath, while keeping the bath temperature at a value not higher than 37° C. and a pH at values ranging from 1.7 to 2.5. After each addition, the hides are treated until they have absorbed at least 90% of the soluble Ti (IV). A gradual addition of sodium sulphite and hexamethylenetetramine is then accomplished: this addition is such as to bring the final pH of the bath to 3.8–4.5 and to exhaust the bath in soluble Ti (IV). $NaHCO_3$ is then added until reaching a pH of the bath ranging from 4.0 to 5.0, such pH value being maintained for at least 2 hours. At least one tanning treatment with a tannin is effected either prior to the treatment with titanyl ammonium sulphate (pretanning), or after the treatment with $NaHCO_3$ (additional tanning), said tanning being accomplished with a synthetic or vegetable tannin in the former case and with a synthetic tannin in the latter case.

Ammonium titanyl sulphate $(NH_4)_2TiO(SO_4)_2.H_2O$ and a method of preparing same are described in French Pat. No. 2,042,206. Another method of preparing this salt is described in Italian Patent Application No. 20,571 A/83. However, the ammonium titanyl sulphate used in the present invention is not subjected to the stabilizing treatment described in French Pat. No. 2,042,206.

During the tanning step with ammonium titanyl sulphate, from 15 to 50% (and preferably from 15 to 30%) by weight of citric acid or alkali metal citrate (calculated as citric acid) with respect to $(NH_4)_2TiO(SO_4)_2.H_2O$ (calculated as $TiO_2$) is generally used: the presence of citric acid or of alkali metal citrate stabilizes the ammonium titanyl sulphate, thus preventing the precipitation of titanium hydroxide. Also essential to this end is to maintain the pH at values ranging from 1.7 to 2.5: if the pH tends to rise or to sink, it is adjusted, for example, with $H_2SO_4$, or with a mixture of sodium sulphite and hexamethylenetetramine. It has also proved to be necessary, after each addition of ammonium titanyl sulphate and citric acid or alkali metal citrate, to treat the hides until they have absorbed at least 90% of the soluble Ti (IV) contained in the bath; this prevents the precipitation of titanium hydroxide. It has been also found that the progressive neutralization of the bath, first with sodium sulphite and hexamethylenetetramine, then with sodium bicarbonate, according to the procedures indicated hereinbefore, is essential for a good tanning process: on one side, the precipitation of titanium hydroxide is prevented during neutralization and, on the other side, it has been ascertained that the effect of the first neutralization is that of fixing in the hide all the titanium (IV) still present in the bath, while the second neutralization aids in completing the chemical reaction between titanium (IV) and the hide and removes from the hide the soluble ions, in particular $SO_4^{--}$.

The tanning with ammonium titanyl sulphate can be preceded by a pretanning step with a synthetic or natural tannin. Before carrying out the pretanning, ammonium sulphate is added and the hide pH is brought to values between 3.8 and 4.5: to this purpose, a slightly tanning acid or a non-tanning acid is added to the bath. This pretanning can be carried out in "dry conditions or with a bath.

The slightly tanning acid is preferably $\alpha$-naphthalenesulfonic acid or $\beta$-naphthalenesulfonic acid or mixtures thereof.

The non-tanning acid is, e.g. formic acid, acetic acid, or sulphuric acid.

The synthetic tannin is, for example, a polycondensate of phenol and formaldehyde, a polycondensate of naphthol and phenol and formaldehyde, or a polycondensate of naphthalenesulfonic acid.

The vegetable tannin is, for example, a mimosa or quebracho extract.

In the pretanning, a synthetic tannin is preferably used.

The tanning with ammonium titanyl sulphate may be followed by an additional tanning with a synthetic tannin or with a rubber-like polymer or with both said agents. However, if no pretanning is carried out, it is then necessary to use a synthetic tannin, either alone or with a rubber-like polymer. The additional tanning is carried out after the treatment with $NaHCO_3$.

The synthetic tannin is selected, for example, from those cited hereinbelow.

The rubber-like polymer is used in the form of a latex or of an aqueous emulsion. It may consist, for example, of a polychloroisoprene, a styrene-butadiene copolymer, a silicone, a polymethylacrylate or a polyethylacrylate or polymethylmethacrylate. Also, mixtures of rubber-like polymers are utilizable.

Both pretanning and additional tanning may be carried out.

A more detailed and preferred embodiment of the present invention is described hereinbelow.

When no tanning is carried out, the hides, after having been subjected to soaking, liming, fleshing and deliming, are put into a drum along with water in an amount generally ranging from 80 to 140% (these and the following percent values are by weight values which, unless otherwise specified, refer to the pelt weight*). The water temperature generally ranges from 20 to 30° C. An amount of $(NH_4)_2SO_4$ generally ranging from 3 to 7% is then added. Usually, the drum is rotated for about 20–30 minutes. Ammonium titanyl sulphate as well as citric acid or alkali metal citrate are then gradually added, for example, 2–4 times. The total amount of ammonium titanyl sulphate generally varies from 3 to 7%, calculated as $TiO_2$. Generally, the total amount of citric acid or alkali metal citrate amounts to 15–50%, calculated as citric acid, with respect to the ammonium titanyl sulphate, calculated as $TiO_2$.

*Note: The pelt weight means the weight of the fleshed hide.

After each addition, the drum is rotated until the hides have absorbed at least 90% of soluble Ti (IV), while keeping the bath pH between 1.7 and 2.5. If 3 equal lots of reagents are additioned, it is necessary to rotate the drum for about 2–4 hours after the first lot has been added, for about 4–6 hours after the second lot has been added, and for about 8–10 hours after the third lot has been added. During this step, the temperature shall not exceed 37° C., the preferred temperature being in the range of from 20° to 33° C.

During the successive steps, sodium sulphite and hexamethylenetetramine are gradually added, for example, 2–3 times. This addition is such as to bring the final pH of the bath to 3.8–4.5 and to exhaust the bath as regards the soluble Ti (IV). Usually, a total amount of 2–4% of each of said neutralizing agents is added. Equal amounts of each of such agents are usually employed. This step takes generally from 4 to 6 hours.

In a subsequent step, $NaHCO_3$ is added until reaching a pH of the bath of from 4.0 to 5.0, such pH being maintained for at least 2 hours. Usually there is employed from 0.3 to 1% of $NaHCO_3$ and the drum is rotated for 2–4 hours, if necessary, $NaHCO_3$ to maintain the pH in the above-mentioned range of values. The bath is then discharged.

If an additional tanning is to be accomplished after having discharged the abovesaid bath, the hides are preferably washed, for example, with 300% of water. The washing water is discharged and 100–200% of water, usually at 25°–35° C., as well as a synthetic tannin and/or an emulsion or a latex of a rubber-like polymer, are added. The synthetic tannin is generally added in amounts ranging from 5 to 15%; the emulsion or the latex containing, for example, 40–60% of rubber-like polymer, is generally added in amounts of from 2 to 8.

If leather having a high impermeability to water is to be obtained, the drum is rotated until obtaining an incomplete penetration of the tannin into the hide, leaving a middle layer unpenetrated. If leather endowed with a high softness is to be obtained, the drum is rotated for a longer time, completing the penetration of the hide by the tannin. The bath is the discharged and the skins are spread and allowed to rest, for example, during 24–48 hours.

When a dry pretanning is carried out, the hides, previously subjected to soaking, liming, fleshing, and deliming, are introduced into a drum. There are generally added from 1.5 to 3.5% of ammonium sulphate and from 1.5 to 3% of a slightly tanning or non-tanning acid, generally diluted in 15–30% of cold water (water being calculated as before on pelt weight). It is generally rotated for 2–4 hours, reaching a pH in the hide ranging from 3.8 to 4.5. From 4 to 8% of synthetic or vegetable tannin is then added and the drum is rotated until exhaustion thereof; that generally takes from 2 to 4 hours. From 1.5 to 3.5% of ammonium sulphate and water until reaching a total amount in the bath between 80 and 140% are successively added; usually, the water temperature is in the range of from 20° to 30° C. Tanning with ammonium titanyl sulphate is then accomplished, as has been described above.

When a pretanning with a bath is carried out, the hides, previously subject to soaking, liming, fleshing, and deliming, are placed into a drum. From 80 to 140% of $H_2O$, usually at 20°–30° C., and from 3 to 7% of ammonium sulphate, are generally added. The drum is generaly rotated for 20–30 minutes, after which from 1.5 to 3% of a slightly tanning acid or of a non-tanning acid is generally added. The drum is usually rotated for 2–4 hours, thus reaching a pH in the hide between 3.8 and 4.5. From 4 to 8% of synthetic or vegetable tannin is then generally added and the drum is rotated until exhaustion thereof; that takes, in general, from 2 to 4 hours. Tanning with ammonium titanyl sulphate, as previously described, is then carried out.

The post-tanning is carried out according to a conventional technique, for example, the one described hereinafter. The pressed and shaved hides in dry condition are put into a drum and brightening agents, for example, based on oxalic acid, are added. The drum is rotated, for example, for 30 minutes. The filling agents, e.g., $MgSo_4$, kaolin, maltol and/or glucose, are then introduced and the drum is rotated until they penetrate into the hides; that takes, for example, 90 minutes. Subsequently, a conventional greasing agent (e.g., degras) is introduced and the drum is rotated until reaching a temperature of, for example, 35°–40° C.

The main advantages achieved with the present invention may be summarized as follows:

- precipitation of titanium hydroxide during tanning is completely avoided;
- Ti (IV) is completely reacted with the hide and the titanium in the bath is fully exhausted;
- it is possible to carry out an additional tanning of the hides with synthetic tannins without causing undesired coloration of the leather; and
- the leathers obtained are endowed with a high softness and flexibility and may have, when so required or desired, a good impermeability to water.

The following examples are given still better to illustrate the novel concept of the present invention.

EXAMPLE 1

7 delimed cow shoulder hides, having a pelt weight of 21 kg, were put into a quick tanning vessel (rotatable drum). The hides were treated with 120% of water at 23° C. and 5% of $(NH_4)_2SO_4$. The drum was rotated for 30 minutes, thus obtaining a limpid bath with a pH of 7.8.

To the tanning bath there were added 2.5% of $TiO_2$, as $(NH_4)_2TiO(SO_4)_2.H_2O$ at 21% of $TiO_2$, and 0.6% of citric acid, and the drum was rotated for 30 minutes. At the end of rotation, the bath exhibited a pH of 2.05 and a temperature of 26° C. The drum was rotated for a further 3.5 hours, whereupon the $TiO_2$ content of the bath was checked, a pH of 2.3 and a $TiO_2$ absorption higher than 90% having been determined.

A further addition of 2.5% to $TiO_2$ as ammonium titanyl sulphate and of 0.6% of citric acid was then effected. After a 30 minute rotation, the bath appeared limpid, its pH being 1.7 and the temperature 25° C.

The drum was further rotated for 8 hours, the $TiO_2$ content of the bath was checked, passing then to the neutralization step using a solid basifying mixture composed of $Na_2SO_3$ and hexamethylenetetramine in the weight ratio of 1:1. A first addition of 2% of basifying mixture was effected, the bath was rotated for 2 hours, a pH of 2.15 and a temperature of 26° C. having been determined.

A second addition of 2% of basifying mixture was effected; the drum was rotated for 2 hours, thus obtaining a bath having a pH of 3.2 and a temperature of 25° C.

Then, a third addition of 2% of basifying mixture was carried out; the drum was rotated for 2 hours and the tanning bath was controlled, obtaining a pH of 4.2 and the disappearance of $TiO_2$ in solution.

Now, a further neutralization with $NaHCO_3$ in an aqueous solution at 9% by weight was accomplished. A first addition of 0.3% of $NaHCO_3$ in 30 minutes was carried out. The drum was rotated for 2 hours, the pH was checked, which was equal to 4.4. A second addition of 0.2% of $NaHCO_3$ was effected, the drum was rotated for 2 hours; the final pH of the bath was 4.5.

Now, the first tanning step was considered to be concluded and the treatment was continued to the discharge of the bath and to the washing of the hides with 300% of water at 30° C., causing the bath to rotate for 30 minutes.

16.5 kg of titanium-tanned hides were treated in a fresh bath with 150% of water at 30° C.; 15% of synthetic tannin of the universal-tanning type based on phenol-formaldehyde condensation polymer was added and additional tanning was begun, checking the synthetic tannin absorption. After a 24-hour rotation, the additional tanning was completed.

The skins were pressed and shaved, whereupon a conventional post-tanning with oxalic acid, maltol, glucose and a greasing agent was carried out.

The leather obtained was soft, very flexible and compact, and exhibited a light color. Its specific weight was like that of leather prepared with vegetable tannin. It was suited for use as soles.

EXAMPLE 2

4.5 kg of delimed cow hides, treated as in Example 1 until completion of the tanning step with titanium, were subjected to the following additional tanning.

The tanning bath was composed of 150% water at 30° C.; 10% of synthetic tannin of the complete-tanning type based on a naphthol-phenol formaldehyde condensation polymer, and 3% of polychloroisoprene. Disappearing of the tanning agents of the bath was followed by means of colorimetric analysis; tanning was concluded in 24 hours.

The pressed and shaved skins were post-tanned, as in Example 1. The leather obtained, compared with that of Example 1, was softer, more flexible, and more impermeable to water. It was suitable for use as insoles.

EXAMPLE 3

Delimed cow backs having a pelt weight of 19 kg were put into a quick-tanning vessel (rotatable drum). The bath was composed of 120% of water at 26° C.; 5% to $(NH_4)_2SO_4$, and 3% of mixture of naphthalenesulfonic acids.

After a 2 hour rotation of the drum, the bath appeared limpid and had a pH of 4.5.

To such tanning bath, 5% of synthetic tannin of the complete-tanning type based on naphthol-phenol formaldehyde condensation polymer was added. After a 4 hour rotation, the tanning agent was absorbed to the extent of more than 90%. Now, 5% of $TiO_2$ as ammonium titanyl sulphate and 1.2% of citric acid were added, and a tanning was carried out according to the procedures of Example 1.

After discharge of the tanning bath and washing of the hides with 300% of water at 30° C., the additional tanning was started. The additional tanning bath contained 150% of water at 30° C., 6% of synthetic tannin of the type suitable for universal tanning based on phenol-formaldehyde condensation polymer, and 4% of polychloroisoprene.

After a 12 hour rotation of the drum, the bath did not contain synthetic tannin any longer.

The present and shaved hides were post-tanned, as in Example 1.

The leather obtained exhibited a light color, was soft and very flexible, and was utilizable for insoles.

EXAMPLE 4

4 delimed cow shoulders, having a pelt weight of 15 kg, were put into a quick-tanning vessel (rotatable drum). The hides were treated with 2.2% of $(NH_4)_2SO_4$, 1.5% of HCOOH, and 15% of $H_2O$; after a 2 hour rotation of the drum, the pH in the hide section reached the desired values (4.3–4.5).

The synthetic tanning was then carried out by adding to the same bath 6% of a pretanning synthetic tannin consisting of a condensation polymer of naphthalenesulfonic acids. After a 4 hour rotation of the drum, the bath was exhausted.

Into the same bath there were introduced 2.5% of $(NH_4)_2SO_4$ and 100% of $H_2O$ at 25° C.; 25% of $(NH_4)_2TiO(SO_4)_2.H_2O$, corresponding to 5% of $TiO_2$, and 25% of citric acid (calculated on $TiO_2$) were then added. The pH of the bath was adjusted to 1.6–2.2 by means of a neutralizing mixture consisting of $Na_2SO_3$ and hexamethylenetetramine.

The tanning procedure with Ti (IV) was repeated, as described in Example 1.

The pressed and shaved hides were post-tanned, as described in Example 1.

The leather obtained was stiffer, lighter and more impermeable than those of the preceding examples. It was suited for use as soles.

EXAMPLE 5

The hides, after having undergone a pretanning and a titanium-tanning according to the procedures of Example 4, were washed with 300% of water at 25° C. The washing water was discharged.

There was then used a bath consisting of 150% of water at 30° C. and 4% of an emulsion of a synthetic polymer based on an acrylic resin. The additional tanning lasted 4 hours.

The pressed and shaved hides were post-tanned, as in Example 1.

The leather obtained was light, waterproof and, as compared with that of Example 4, softer and more flexible. It was suited for use as soles.

What is claimed is:

1. A process for tanning hides for soles or insoles in which the hides, after having undergone soaking, liming, fleshing, and deliming, are tanned with ammonium titanyl sulphate, characterized in that the hides are first treated with ammonium sulphate; successively ammonium titanyl sulphate and citric acid or an alkali metal citrate are gradually added to the bath, maintaining the bath temperature at a value not exceeding 37° C. and the bath pH at values ranging from 1.7 to 2.5; after each addition the hides are treated until they absorb at least 90% of the soluble Ti (IV); a gradual addition of sodium sulphite and hexmethylenetetramine is then carried out, this addition being such as to bring the final pH of the bath to 3.8–4.5 and to exhaust the soluble Ti (IV) in the bath; $NaHCO_3$ is then added till reaching a pH of the bath ranging from 4.0 to 5.0, such pH being maintained for at least 2 hours; at least one tanning treatment with a tannin, either before the treatment with ammonium titanyl sulphate (pretanning), or after the treatment with $NaHCO_3$ (additional tanning) is carried out, said tanning being accomplished with a synthetic or a vegetable tannin in the former case, and with a synthetic tannin in the latter case.

2. The process according to claim 1, characterized in that in the tanning step with ammonium titanyl sulphate, from 15 to 50% by weight of citric acid or alkali metal citrate (calculated as citric acid) with respect to ammonium titanyl sulphate (calculated as $TiO_2$) is used.

3. The process according to claim 1 or 2, characterized in that the pretanning is accomplished as follows: the hide pH is brought to values ranging from 3.8 to 4.5 by treatment with a slightly tanning acid or with a non-tanning acid; successively the hides are treated with a synthetic or a vegetable tannin.

4. The process according to claim 1 or 2, characterized in that the additional tanning is carried out with a synthetic tannin or with a synthetic tannin and a rubber-like polymer.

5. The process according to claim 1 or 2, characterized in that when a pretanning has taken place, the additional tanning is carried out with a rubber-like polymer.

6. The process according to claim 3, characterized in that the slightly tanning acid is selected from the group consisting of $\alpha$-naphthalenesulfonic acid, $\beta$-naphthalenesulfonic acid, and mixtures thereof.

7. The process according to claim 3, characterized in that the non-tanning acid is selected from the group consisting of formic acid, acetic acid, and sulphuric acid.

8. The process according to claim 1 or 2, characterized in that the synthetic tannin is selected from the group consisting of a phenol and formaldehyde polycondensate, a naphthol and phenol and formaldehyde polycondensate, and a naphthalenesulfonic acid polycondensate.

9. The process according to claim 4, characterized in that the rubber-like polymer is selected from the group consisting of a polychloroisoprene, a butadiene-styrene copolymer, a silicone, a polymethylacrylate, a polyethylacrylate, and a polymethylmethacrylate.

10. Leather for soles or insoles when tanned by the process as claimed in claim 1.

* * * * *